US006158120A

United States Patent [19]

Foster et al.

[11] Patent Number: 6,158,120

[45] Date of Patent: Dec. 12, 2000

[54] METHOD FOR MAKING A CATALYTIC CONVERTER CONTAINING A MULTIPLE LAYER MAT

[75] Inventors: Michael Ralph Foster, Columbiaville, Mich.; Robert Anthony Lawrence, Nobelsville, Ind.; Stephen Joe Myers, Owosso; Alan Gerard Turek, Mayville, both of Mich.

[73] Assignee: General Motors Corporation, Detroit, Mich.

[21] Appl. No.: 09/211,671

[22] Filed: Dec. 14, 1998

[51] Int. Cl.[7] ..... B21D 51/16; B01D 53/34

[52] U.S. Cl. ..... 29/890; 422/179; 422/181

[58] Field of Search ..... 29/890; 422/177, 422/179, 181; 16/225; 428/130

[56] References Cited

U.S. PATENT DOCUMENTS 5,028,397 7/1991 Merry ..... 422/179

5,332,609 7/1994 Corn ..... 428/77

5,631,053 5/1997 Andersen et al. ..... 428/36.4

5,787,584 8/1998 Shea et al. ..... 29/890

OTHER PUBLICATIONS

U.S. Ser. No. 09/178,589 and Ser. No. 08/943,847.

*Primary Examiner*—Marian C. Knode

*Assistant Examiner*—Susan Ohorodnik

*Attorney, Agent, or Firm*—Vincent A. Cichosz

[57] ABSTRACT

An intumescent catalyst mounting mat is provided by cutting a single piece of mat into a desired profile and cutting a slit about ½ way through the thickness of the mat at a selected fold line. The mat is then easily folded upon itself to create a double thickness mat that is already secured to the next layer and may have any desired profile.

5 Claims, 2 Drawing Sheets

METHOD FOR MAKING A CATALYTIC CONVERTER CONTAINING A MULTIPLE LAYER MAT

TECHNICAL FIELD

The present invention relates to catalytic converters. More particularly, the present invention relates to a method for producing multiple layer intumescent mats for catalytic converters at reduced cost.

BACKGROUND OF THE INVENTION

The generally accepted means for mounting a catalytic substrate material in a catalytic converter housing is with an intumescent mat material. Mat materials range significantly in weight and thickness per given area. Thin materials are relatively easy to wrap around a substrate. As trends are toward thicker total mat thickness however (i.e. higher mat density in a finished catalytic converter), the process of wrapping the substrate is increasingly more difficult. The difficulty is occasioned by the natural buckling at the inside radius of a thicker material caused by tension in the outside radius. The tension is because the outside surface must travel a circumferentially longer distance than the inside surface of the mat.

One previously known way to reduce the difficulty in a thick mat is to cut the material part way through at various locations around a catalyst substrate to remove tension in the outer circumferential material of the mat. While this process of cutting the outer fibers works well, it is only advantageous if the desired thickness of mat can be obtained from a single layer of material.

Another prior art method for easing the difficulty of wrapping thicker mats is to use multiple thin layers instead. While clearly this method avoids the buckling of thicker mats making wrapping easier, each mat needed to be wrapped separately increasing the number of steps in the process to produce a catalytic converter. More steps generally translate to more cost and more time. For these reasons the method is not desirable.

An attempt to streamline the latter method was to glue the multiple individual thin sheets together at one end or in the center so that they can be applied in a single step. While effective in ordinary multiple wrapping steps, the gluing itself requires additional time and process steps as well as increasing materials cost.

The wrapping of catalytic substrate materials is further complicated by prior art procedures concerned with the mating end edges of the mat. More specifically, prior art joints in the mat have employed a tongue and groove arrangement (see FIG. 1). While the tongue and groove joint is effective for its intended purpose it renders automation of the wrapping process difficult.

Attempts to render the joint more friendly to automation include using an "L" joint (see FIG. 2). While the joint is easier to index, a wrapping process using the joint is still difficult to automate.

SUMMARY OF THE INVENTION

It is an object of the present invention to reduce the difficulty of wrapping a catalytic substrate in a mat having a high weight per area.

It is a further object of the invention to reduce process steps in wrapping a catalytic substrate in the intumescent mat.

It is yet a further object of the invention to reduce the cost of producing a catalytic converter by implementing the above objects.

It is yet still a further object of the invention to enhance automation of the construction of catalytic converters by implementing a butt joint for the mat.

Advantageously, all of the above objects are achieved by partial cutting and folding a mat having a thickness that when doubled or tripled, etc. equals the thickness specified for the produced catalytic converter. Differing lengths and widths of the mat in a single layer or in individual layers of a group of layers is easily accommodated. The partially cut and folded mat is butted together at the joint between leading and trailing edges so is very conducive to automation of the entire process.

BRIEF DESCRIPTION OF THE DRAWINGS

The present invention will now be described, by way of example only, with reference to the accompanying drawings in which.

DETAILED DESCRIPTION OF THE INVENTION

The invention simplifies and speeds the process of wrapping a catalytic substrate for the production of a catalytic converter with an intumescent mat material where design specifications require a thicker overall thickness mat by employing a single thinner mat which is then folded upon itself in a desired pattern to provide the specified thickness and shape. Moreover, the invention enhances foldability of the mat while retaining a connection between the two layers (needed for a single step wrapping operation).

Figure 3:
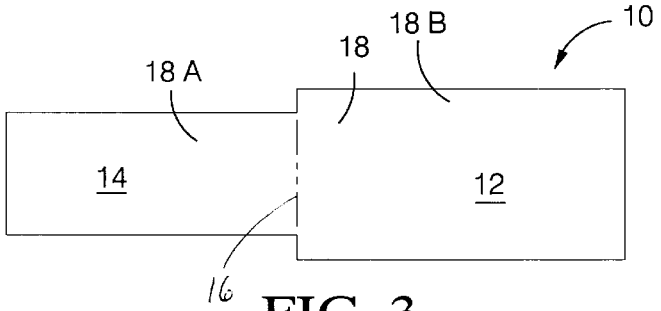
FIG. 3 is a plan view of a mat of the invention having been shaped in outer perimeter to a selected geometric shape.
Figure 4:
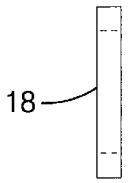
FIG. 4 is an end view of the mat of FIG. 3.
Figure 6:
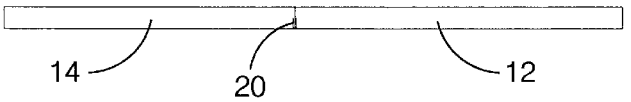
FIG. 6 is a side view of the mat of FIG. 3.

Referring to FIG. 3 a mat 10 is shaped in perimetrical dimension to meet particular specification. In this example, the mat 10 is shaped to provide a two layer mat for wrapping a substrate wherein one layer has different dimensions than the other. Referring to FIG. 3, mat 10 comprises body 12 and flap 14 delineated at fold line 16. Surface 18 of mat 10 is subdivided for purposes of clarity of discussion into surface 18*a* and surface 18*b* which are also delineated by fold line 16. Upon folding the mat, surface 18*a* is in contact with surface 18*b*.

Figure 9:
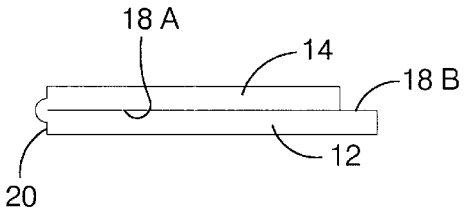
FIG. 9 is a side view of the mat of FIG. 7.

Facilitating ease of folding of mat 10 which otherwise would tend to bind and not fold flat is a slit 20 which is best seen in FIG. 9 in its expanded condition. Slit 20 preferably extends to one-half the mat thickness and for all of its width. Flap 14 then easily folds atop body 12 when folded in a direction to open slit 20.

Figure 7:
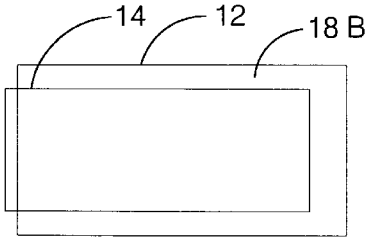
FIG. 7 is a plan view of the mat of FIG. 3 with the left side of the mat folded over the right side of the mat.
Figure 8:
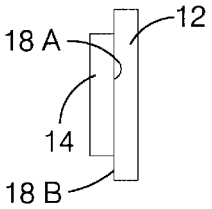
FIG. 8 is an end view of the mat of FIG. 7.
Figure 10:
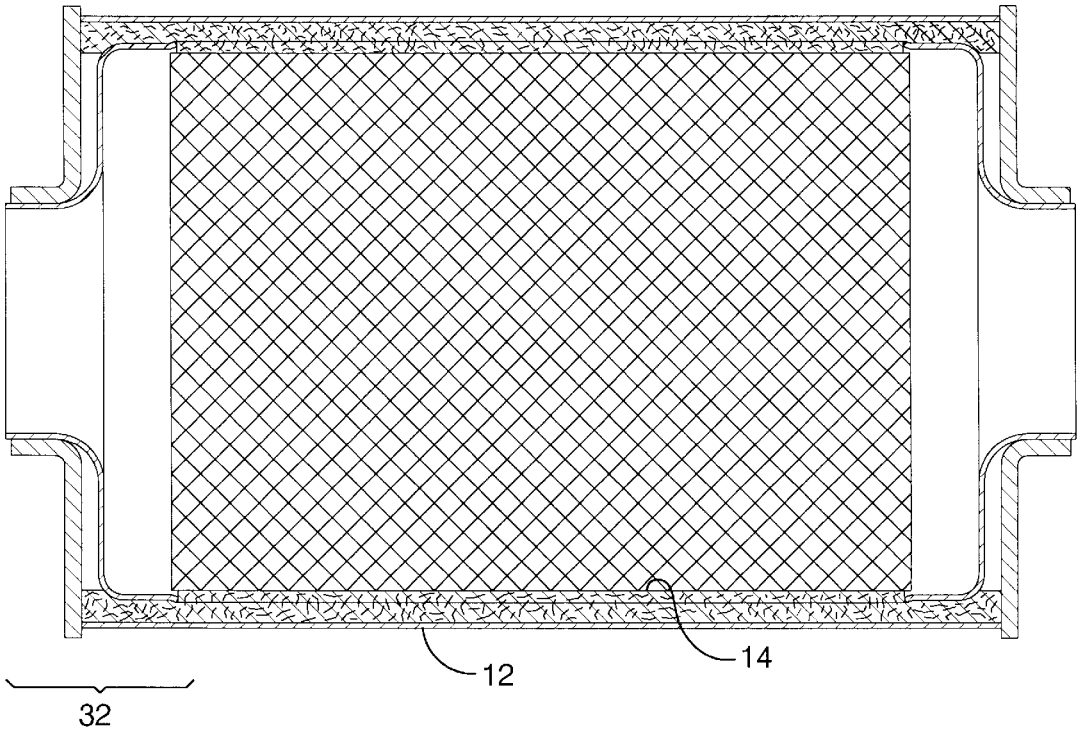
FIG. 10 is a cross section view of an end plate catalytic converter with internal end cones.

As shown in FIGS. 7–9, the mat in this example uses a flap that is smaller in two dimensions than the body. This has two purposes: first a shorter length of flap 14 than body 12 allows the inside (flap 14) and outside (body 12) layers to meet uniformly when wrapped around a catalyst. More specifically, because flap 14 is to travel a circumferentially (or perimetrically if the substrate is not cylindrical) shorter path than body 12, body 12 must be longer to end flush with flap 14 when in the wrapped condition. With respect to the width of flap 14 relative to body 12, it will be appreciated that the former is less wide. This is for a catalytic converter such as the one illustrated in cross section in FIG. 10 where only a single layer of mat material is desired in the end cone assemblies 32. In this example body 12 and flap 14 are both around the substrate.

Figure 1:
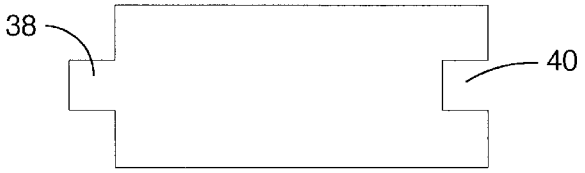
PRIOR ART FIG. 1
FIG. 1 is an illustration of a prior art tongue and groove mat.
Figure 2:
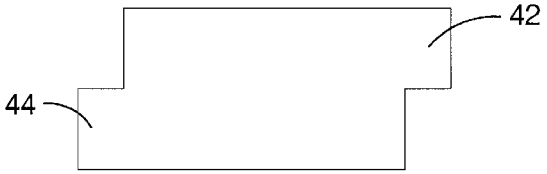
PRIOR ART FIG. 2
FIG. 2 is an illustration of a prior art "L" joint mat.
Figure 5:
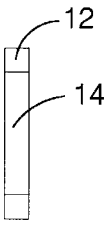
FIG. 5 is an end view of the mat of FIG. 3 which illustrates the opposite end from the view of FIG. 4.
Figure 11:
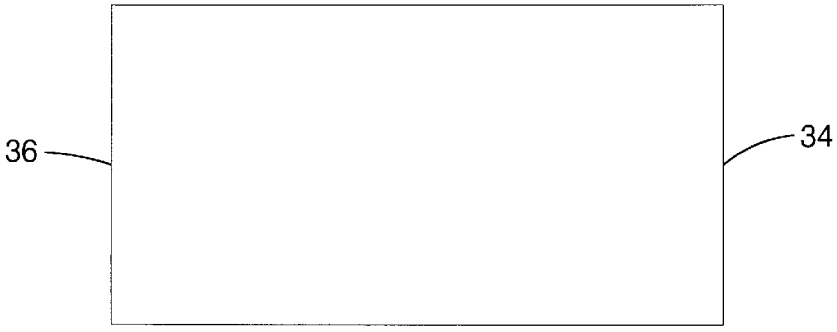
FIG. 11 is a new mat cut shape of the invention.

Another innovation that has helped with automatability of catalytic converter construction and speeds the process of the invention is to remove the tongue and groove or "L" joint (FIGS. 1 and 2) profiles of the prior art and replace them with the profile of FIG. 11. By end butting the mat, indexing problems are substantially avoided. More specifically, mat edges 34 and 36 do not exhibit any complex shape that would otherwise need to be indexed. Referring to FIG. 1, it will be appreciated that a high accuracy index is necessary to properly mesh the tongue 38 and groove 40. Referring to FIG. 2, and although it bears a simplified joint having an "L" shape as opposed to a tongue and groove, the joint being defined by tabs 42 and 44, there still is required a fair degree of indexing that makes automation difficult. The inventive mat shape (FIG. 11) eliminates these problems.

The mat of FIG. 11 is measured to be long enough to have its ends 34 and 36 butt together upon being wrapped around a catalytic substrate material. Upon compression of the mat during the "canning" procedure, additional flow of the mat material takes place which tightens the joint and prevents exhaust gas leaks through the joint.

Because of the lack of a need for specific indexing, automation is less burdensome and thus is more readily accomplished. The configuration of FIG. 11 is also of a lower cost to prepare due to the simple cut pattern.

It will be understood that a person skilled in the art may make modifications to the preferred embodiment shown herein within the scope and intent of the claims. While the present invention has been described as carried out in a specific embodiment thereof, it is not intended to be limited thereby but is intended to cover the invention broadly within the scope and spirit of the claims.

What is claimed is:

1. A method for making a catalytic converter, comprising the steps of:

cutting a mat to a selected shape, where the shape is defined by two adjacent rectangular areas and a first of the rectangular areas is smaller in width and length than a second of the rectangular areas;

partial cutting the mat to create at least one slit in the mat material along a fold line between the two adjacent rectangular areas of the mat;

folding the mat upon itself to open the at least one slit and overlaying the first rectangular area of the mat upon the second rectangular area of the mat, thereby creating a folded mat;

wrapping said folded mat around a catalytic substrate material to create an assembly, such that the first rectangular area of the folded mat is positioned adjacent to the catalytic substrate material, thereby serving as an inner layer of the folded mat; and placing said assembly within a catalytic converter housing, thereby making a catalytic converter.

2. The method of claim 1 wherein the step of partial cutting the mat further comprises cutting about ½ the thickness of the mat material.

3. The method of claim 1 wherein the step of partial cutting the mat further comprises cutting the slit along the entire width of the mat.

4. The method of claim 1 wherein the step of wrapping said folded mat further comprises dimensioning said folded mat to extend lengthwise beyond said catalytic substrate material to form a cylinder portion at each end of said assembly.

5. The method of claim 4 further comprising the step of inserting a cone end into each cylinder portion of said assembly, where an annular ledge within the cylinder portion is formed by the inner layer of the folder mat and the cone end abuts against the annular ledge of the assembly.

* * * * *